US006096381A

United States Patent [19]

Zheng

[11] Patent Number: 6,096,381

[45] **Date of Patent: *Aug. 1, 2000**

[54] PROCESS FOR DENSIFYING AND PROMOTING INTER-PARTICLE BONDING OF A BOND COAT FOR A THERMAL BARRIER COATING

[75] Inventor: Xiaoci Maggie Zheng, Clifton Park, N.Y.

[73] Assignee: General Electric Company, Schenectady, N.Y.

[ * ] Notice: This patent is subject to a terminal disclaimer.

[21] Appl. No.: 08/958,169

[22] Filed: Oct. 27, 1997

[51] Int. Cl.[7] ..... C23C 4/06; C23C 4/18

[52] U.S. Cl. ..... 427/454; 427/455; 427/456

[58] Field of Search ..... 427/454, 456, 427/455

[56] References Cited

U.S. PATENT DOCUMENTS

| | | | |
|---|---|---|---|
| 4,095,003 | 6/1978 | Weatherly et al. | 427/454 |
| 4,275,124 | 6/1981 | McComas et al. | 428/564 |
| 5,236,745 | 8/1993 | Gupta et al. | 427/454 |
| 5,817,372 | 10/1998 | Zheng | 427/456 |

*Primary Examiner*—Katherine A. Bareford

*Attorney, Agent, or Firm*—Domenica N.S. Hartman; Robert C. Lampe, Jr.; Noreen C. Johnson

[57] ABSTRACT

A method of depositing a bond coat (16) of a thermal barrier coating (TBC) system (14) for a component (10) designed for use in a hostile thermal environment. The method yields a bond coat (16) having an adequate surface roughness for adhering a plasma-sprayed ceramic layer (18), while also exhibiting high density and low oxide content. The method generally entails forming the bond coat (16) by depositing a metal powder on the substrate (12) using a plasma spray or high velocity oxy-fuel (HVOF) technique. The metal powder contains particles that are sufficiently large to incompletely melt during deposition, yielding a surface roughness of at least about 350 microinches Ra. The large particles cause the bond coat (16) to have relatively low density and a propensity to oxidize, both at the surface of the bond coat (16) and internally due to the porosity of the bond coat (16). The propensity for internal oxidation is considerably reduced by heat treating the bond coat (16) in a vacuum or inert atmosphere after deposition and before exposure to a high temperature oxidizing environment, such that interparticle diffusion bonding and densification of the bond coat (16) are promoted without oxidizing the bond coat (16). Thereafter, a ceramic layer (18) is plasma sprayed on the bond coat (16) without forming an oxide scale on the particle surfaces, which if formed would prevent subsequent interparticle diffusion bonding, leaving unclosed porosity that reduces the oxidation life of the bond coat (16).

4 Claims, 2 Drawing Sheets

PROCESS FOR DENSIFYING AND PROMOTING INTER-PARTICLE BONDING OF A BOND COAT FOR A THERMAL BARRIER COATING

FIELD OF THE INVENTION

The present invention relates to protective coatings for components exposed to high temperatures, such as components of a gas turbine engine. More particularly, this invention is directed to a process for forming a dense bond coat of a thermal barrier coating system, and specifically those coating systems employing a thermally-sprayed thermal-insulating layer.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures due to oxidation and/or hot corrosion when located in certain high-temperature sections of a gas turbine engine, such as the turbine, combustor or augmentor. Examples of such components include buckets (blades) and nozzles (vanes) in the turbine section of a gas turbine engine. A common solution is to protect the surfaces of such components with an environmental coating system, such as an aluminide coating, an overlay coating or a thermal barrier coating system (TBC). The latter includes a layer of thermal-insulating ceramic adhered to the superalloy substrate with an environmentally-resistant bond coat.

Metal oxides, such as zirconia ($ZrO_2$) that is partially or fully stabilized by yttria ($Y_2O_3$), magnesia (MgO) or another oxide, have been widely employed as the material for the thermal-insulating ceramic layer. The ceramic layer is typically deposited by air plasma spray (APS), vacuum plasma spray (VPS), also called low pressure plasma spray (LPPS), or a physical vapor deposition (PVD) technique, such as electron beam physical vapor deposition (EBPVD) which yields a strain-tolerant columnar grain structure. APS is often preferred over other deposition processes because of low equipment cost and ease of application and masking. Notably, the adhesion mechanism for plasma-sprayed ceramic layers is by mechanical interlocking with a bond coat having a relatively rough surface, preferably about 350 microinches to about 750 microinches (about 9 to about 19 $\mu$m) Ra.

Bond coats are typically formed from an oxidation-resistant alloy such as MCrAlY where M is iron, cobalt and/or nickel, or from a diffusion aluminide or platinum aluminide that forms an oxidation-resistant intermetallic, or a combination of both. Bond coats formed from such compositions protect the underlying superalloy substrate by forming an oxidation barrier for the underlying superalloy substrate. In particular, the aluminum content of these bond coat materials provides for the slow growth of a dense adherent aluminum oxide layer (alumina scale) at elevated temperatures. This oxide scale protects the bond coat from oxidation and enhances bonding between the ceramic layer and bond coat.

Aside from those formed by diffusion techniques and physical or chemical vapor deposition, bond coats are typically applied by thermal spraying, e.g., APS, VPS and high velocity oxy-fuel (HVOF) techniques, all of which entail deposition of the bond coat from a metal powder. The structure and physical properties of such bond coats are highly dependent on the process and equipment by which they are deposited. The surface preparation requirements for a substrate on which a VPS bond coat is to be applied are typically different from that required for APS and HVOF bond coats. Relatively small grit sizes (typically about 60 to about 120 $\mu$m) are used to grit blast a substrate before applying a VPS bond coat, which usually results in a substrate surface roughness of less than about 200 microinches Ra (about 5 $\mu$m). Vacuum heat treatment is typically applied after VPS to diffusion bond the bond coat to the substrate.

In contrast, grit sizes of about 170 to about 840 $\mu$m are typically used to grit blast substrates on which an APS or HVOF bond coat is to be applied. Because the adhesion mechanism between a substrate and an APS and HVOF bond coat is by mechanical interlocking, these bond coats do not typically undergo a vacuum heat treatment prior to deposition of the thermal barrier coating. Air plasma possesses a high heat capacity in the presence of air, which enables relatively large particles to be melted using APS. As a result, coarser metal powders can be used that yield bond coats having a rougher surface, e.g., in the 350 to 750 microinch range suitable for adhering a plasma-sprayed ceramic layer, than is possible with VPS. The particle size distribution of such powders is Gaussian as a result of the sieving process, and are typically broad in order to provide finer particles that fill the interstices between larger particles to reduce porosity. However, the finer particles are prone to oxidation during the spraying process, resulting in a bond coat having a very high oxide content. The low momentum possessed by the sprayed particles in the APS process also promotes porosity in the coating. Consequently, as-sprayed APS bond coats inherently contain relatively high levels of oxides and are more porous than are VPS bond coats. Because of their higher level of oxides and porosity, APS bond coats are more prone to oxidation than are VPS bond coats.

As indicated above, HVOF bond coats do not undergo a vacuum heat treatment before deposition of a thermal barrier coating, since adhesion of an HVOF bond coat to its substrate is by mechanical interlocking. Bond coats deposited by HVOF techniques are very sensitive to particle size distribution of the powder because of the relatively low spray temperature of the HVOF process. Accordingly, HVOF process parameters have been typically adjusted to spray powders having a very narrow range of particle size distribution. To produce an HVOF bond coat suitable for a plasma-sprayed ceramic layer, a coarse powder must typically be used in order to achieve the required surface roughness. However, because coarse particles cannot typically be fully melted at suitable HVOF parameters, HVOF bond coats of the prior art have typically had relatively high porosity and poor bonding between sprayed particles.

In view of the above, it can be seen that, while bond coats deposited by various techniques have been successfully employed, each has advantages and disadvantages that must be considered for a given application. In particular, while APS processes readily yield a bond coat having adequate surface roughness to adhere a plasma-sprayed ceramic layer, porosity and the tendency for oxidation in such bond coats are drawbacks to the protection and adhesion they provide to the underlying substrate. Because of poor bonding between particles, oxygen readily diffuses into HVOF bond coats subjected to a high-temperature oxidation environment, causing oxidation of the bond coat at the multiple surfaces of the loosely bonded particles.

Accordingly, what is needed is a process by which the surface roughness necessary for a plasma-sprayed ceramic layer can be achieved with a bond coat that also exhibits low porosity and oxidation.

SUMMARY OF THE INVENTION

According to the present invention, there is provided a method of forming a bond coat of a thermal barrier coating (TBC) system for components designed for use in a hostile thermal environment, such as turbine buckets and nozzles, combustor components, and augmentor components of a gas turbine engine. The method yields a bond coat having an adequate surface roughness for adhering a plasma-sprayed ceramic layer, while also exhibiting high density and low oxide content. Consequently, bond coats produced by the method of this invention are protective and yield thermal barrier coating systems that are highly resistant to spallation.

The method generally entails forming a bond coat on a substrate by depositing a metal powder on the substrate by plasma spraying or another suitable process, such as a high velocity oxy-fuel (HVOF) technique. To yield a bond coat that exhibits adequate surface roughness to adhere a plasma-sprayed ceramic layer, the metal powder contains a sufficient amount of large particles that incompletely melt during deposition, such that the large particles at the surface of the bond coat yield a surface roughness of at least about 350 microinches (about 9 $\mu$m) Ra. A consequence of obtaining the desired surface roughness with the large particles is that the bond coat is characterized by a relatively low density and a propensity to oxidize, both at the surface of the bond coat and internally due to passages through the bond coat resulting from poor bonding between sprayed particles. Rapid oxidation would occur if such a bond coat is subjected to high temperatures in an oxidizing environment, such as the high temperature exposure that occurs during the subsequent plasma spraying of a ceramic layer on the bond coat.

According to this invention, oxidation of the bond coat prior to deposition of the ceramic layer is inhibited by immediately heat treating the bond coat in a nonoxidizing environment, e.g., a vacuum or inert atmosphere, to diffusion bond the particles of the metal powder and densify the bond coat without oxidizing the bond coat. Thereafter, a thermal-insulating (e.g., ceramic) layer can be thermally sprayed on the bond coat without forming a layer of oxide scale on the surfaces of the loosely bonded particles. The oxide scale, if formed, would prevent those particles from diffusion bonding to each other even if the bond coat is heat treated in a nonoxidizing environment after deposition of the ceramic layer. According to the invention, a suitable heat treatment in a nonoxidizing atmosphere permits the bond coat to be preheated prior to deposition of the thermal-insulating layer, and permits plasma spraying of the thermal-insulating layer during which the bond coat can reach temperatures of 300° C. or more.

From the above, it can be seen that the method of this invention produces a bond coat having a surface roughness necessary for a plasma-sprayed ceramic layer of a TBC system, while also reducing porosity and oxidation of the bond coat. Accordingly, bond coats produced by the present invention are able to adhere plasma-sprayed ceramic layers while inhibiting oxidation of the underlying substrate, such that the TBC system exhibits a desirable level of spallation resistance.

Other objects and advantages of this invention will be better appreciated from the following detailed description.

DETAILED DESCRIPTION OF THE INVENTION

The present invention is generally applicable to metal components that are protected from a thermally hostile environment by a thermal barrier coating (TBC) system. Notable examples of such components include the high and low pressure turbine nozzles (vanes) and buckets (blades), shrouds, combustor liners, transition pieces and augmentor hardware of gas turbine engines. While the advantages of this invention are particularly applicable to turbine engine components, the teachings of this invention are generally applicable to any component on which a thermal barrier may be used to thermally insulate the component from its environment.

Figure 1:
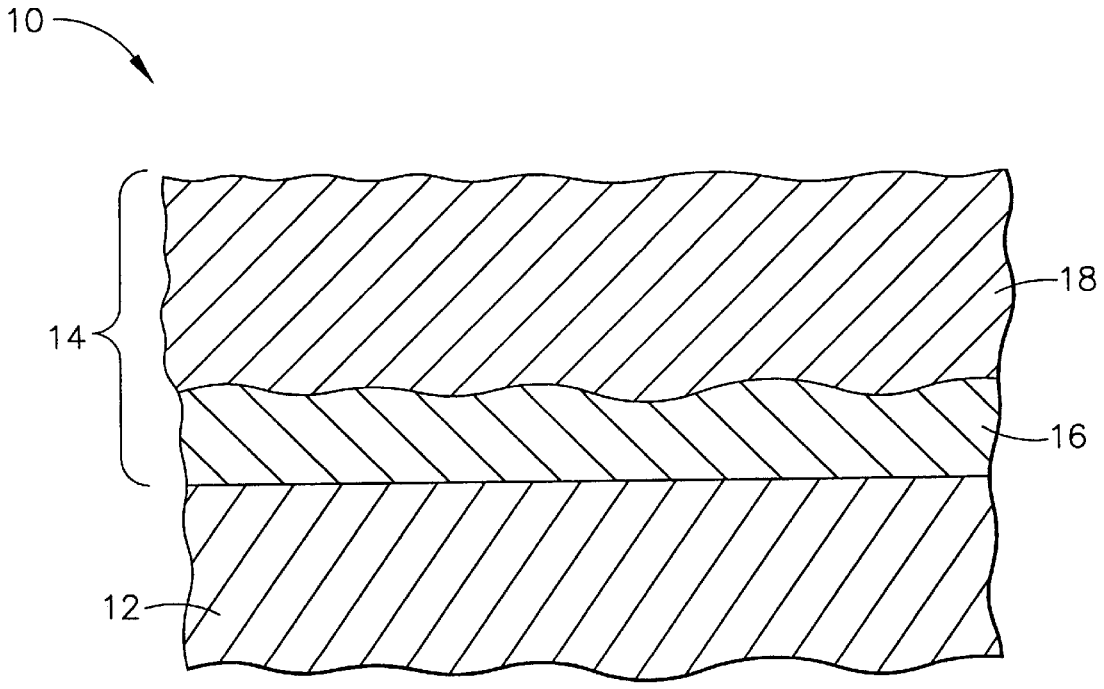
FIG. 1 schematically represents a thermal barrier coating system having a bond coat deposited by a vacuum plasma spray or high velocity oxy-fuel process in accordance with this invention.

A partial cross-section of a turbine engine component 10 having a thermal barrier coating system 14 in accordance with this invention is represented in FIG. 1. The coating system 14 is shown as including a thermal-insulating ceramic layer 18 bonded to a substrate 12 with a bond coat 16. As is the situation with high temperature components of a turbine engine, the substrate 12 may be formed of an iron, nickel or cobalt-base superalloy, though it is foreseeable that other high temperature materials could be used. According to this invention, the ceramic layer 18 is deposited by plasma spraying techniques, such as air plasma spraying (APS) and vacuum plasma spraying (VPS), also known as low pressure plasma spraying (LPPS). A preferred material for the ceramic layer 18 is an yttria-stabilized zirconia (YSZ), though other ceramic materials could be used, including yttria, partially stabilized zirconia, or zirconia stabilized by other oxides, such as magnesia (MgO), ceria ($CeO_2$), scandia ($S_2c_3O$), alumina ($Al_2O_3$), etc.

The bond coat 16 must be oxidation-resistant so as to be capable of protecting the underlying substrate 12 from oxidation and inhibiting spallation of the plasma-sprayed ceramic layer 18. In addition, the bond coat 16 must be sufficiently dense and have relatively low levels of oxides to further inhibit oxidation of the substrate 12. Prior to or during deposition of the ceramic layer 18, an alumina ($Al_2O_3$) scale (not shown) may be formed on the surface of the bond coat 16 by exposure to elevated temperatures, providing a surface to which the ceramic layer 18 tenaciously adheres. For this purpose, the bond coat 16 preferably contains alumina- and/or chromia-formers, i.e., aluminum, chromium and their alloys and intermetallics. Preferred bond coat materials include MCrAl and MCrAlY, where M is iron, cobalt and/or nickel.

Finally, because the ceramic layer 18 is deposited by plasma spraying, the bond coat 16 must have a sufficiently rough surface, preferably at least 350 microinches (about 9 $\mu$m) in order to mechanically interlock the ceramic layer 18 to the bond coat 16. Contrary to the prior art, the process of this invention does not require an APS process to form the bond coat 16, but instead is able to produce a bond coat 16 having sufficient surface roughness using essentially any thermal spray process, such as vacuum plasma spray (VPS), high velocity oxy-fuel (HVOF), and wire-arc spray. Notably, prior art VPS bond coats are too smooth to adequately adhere a plasma-sprayed bond coat, and prior art HVOF bond coats have been produced with adequate surface roughness but at the expense of lower coating densities that allow internal oxidation to occur within the bond coat if subjected to elevated temperatures and oxidizing conditions prior to deposition of the ceramic layer.

In order to obtain a VPS or HVOF bond coat 16 that has desirable surface roughness, the deposition process of this invention employs a metal powder that includes a sufficient quantity of relatively large particles that only partially melt during the deposition process, yielding an adequate surface roughness for adhering a plasma-sprayed ceramic layer 18 to the bond coat 16. A preferred metal powder contains a bimodal (dual-peak) particle size distribution, entailing a combination of finer and coarser powders that are deposited separately, combined to form a powder mixture prior to deposition, or a combination of the two. Alteratively, a powder characterized by a Gaussian particle size distribution may be used. The common requirement is that the powder contain a sufficient amount of coarse particles having diameters of at least 40 $\mu$m to yield a bond coat 16 having a surface roughness of about 350 microinches to about 750 microinches (about 9 to about 19 $\mu$m) Ra.

However, the presence of the partially melted coarse particles within the bond coat 16 inherently reduces the bonding between the sprayed particles. In addition, gaps between the coarse particles provide diffusion paths for oxygen to penetrate into and oxidize the bond coat 16 at high temperatures. During the evaluation of this invention, it was determined that a bond coat 16 could be deposited by VPS and HVOF techniques without generating an unacceptable level of oxides, though subsequent oxidation of the bond coat 16 was likely due to the lower density of the bond coat 16 attributable to gaps between and around the large particles required to achieve the necessary surface roughness. According to this invention, this problem is overcome with a heat treatment performed on the bond coat 16 following its deposition to enhance diffusion bonding between the metal powder particles and increase the density of the bond coat 16, thereby inhibiting internal oxidation of the bond coat 16. A suitable heat treatment is to subject the bond coat 16 to a temperature of about 950° C. to about 1150° C. for a duration of about one to about six hours in a vacuum or inert atmosphere immediately after the bond coat 16 has been formed. In a preferred embodiment, the oxide content of the bond coat 16 is maintained at not more than 3 volume percent while density is increased to at least 95 percent of theoretical following the heat treatment.

The ability to inhibit oxidation of the bond coat 16 following its deposition and prior to deposition of the ceramic layer 18 is relevant if the bond coat 16 must be heated prior to deposition of the ceramic layer 18, or if deposition of the ceramic layer 18 causes heating of the bond coat 16, e.g., above about 300° C. The porosity of the bond coat 16 is also critical if, prior to depositing the ceramic layer 18, an alumina ($Al_2O_3$) scale is to be formed on the surface of the bond coat 16 by exposure to elevated temperatures. While such procedures are known and necessary if an EBPVD ceramic layer is to be deposited on a VPS or LPPS bond coat, preforming an alumina scale on the bond coat 16 for the plasma-sprayed ceramic layer 18 of this invention is not, since plasma spraying of ceramic materials to form a TBC has previously been limited to being deposited on APS bond coats that cannot form a continuous protective alumina scale. Furthermore, while vacuum heat treatment of VPS and EBPVD TBC systems is known in the art, such heat treatments have been for the purpose of diffusion bonding the bond coat to its substrate and relieving stresses induced during the coating process. Therefore, such heat treatments have not been used or suggested for reducing the porosity of an HVOF bond coat before depositing a plasma-sprayed ceramic layer. Because an oxide scale is already present on the surfaces of the sprayed particles that form an APS bond coat due to the high temperature spraying process, the density of an APS bond coat cannot be improved by a heat treatment due to its inherent oxide content.

Two groups of TBC specimens, each with an HVOF bond coat, were formed using a NiCrAlY powder on a superalloy substrate. The HVOF bond coats of a first group ("Group A") of the specimens were sprayed with powder particles of 45 $\mu$m or less, yielding a surface roughness of about 350 microinches (about 9 $\mu$m) Ra. The HVOF bond coats of the second group ("Group B") of specimens were sprayed with powder particles between 44 $\mu$m and 89 $\mu$m, yielding a surface roughness of about 550 microinches (about 14 $\mu$m) Ra. Prior to deposition of the TBC, half of each group was heat treated in accordance with this invention at a temperature of about 1065° C. for a duration of about four hours in a vacuum. Furnace cycle tests (FCT) were then performed on the specimens. The tests entailed 45 minute cycles of heating to about 1149° C. followed by cooling. Each specimen was tested in this manner until its TBC spalled. Averaged results of the tests are provided below in Table I.

TABLE I

| | Heat Treated | Not Heat Treated |
|---|---|---|
| Group A | 9.15 hours | 6.15 hours |
| Group B | 7.22 hours | 4.65 hours |

Figure 2:
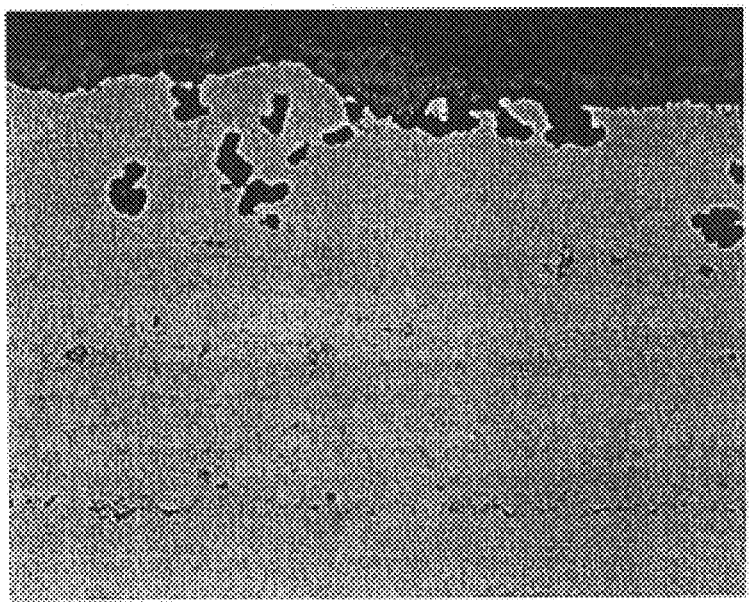
FIGS. 2 and 3 are scanned images of HVOF bond coats that have undergone furnace cycle testing, FIG. 2 showing the condition of an HVOF bond coat that had previously undergone a vacuum heat treatment in accordance with this invention and FIG. 3 showing the condition of an HVOF bond coat that had not undergone a vacuum heat treatment prior to testing.
Figure 3:
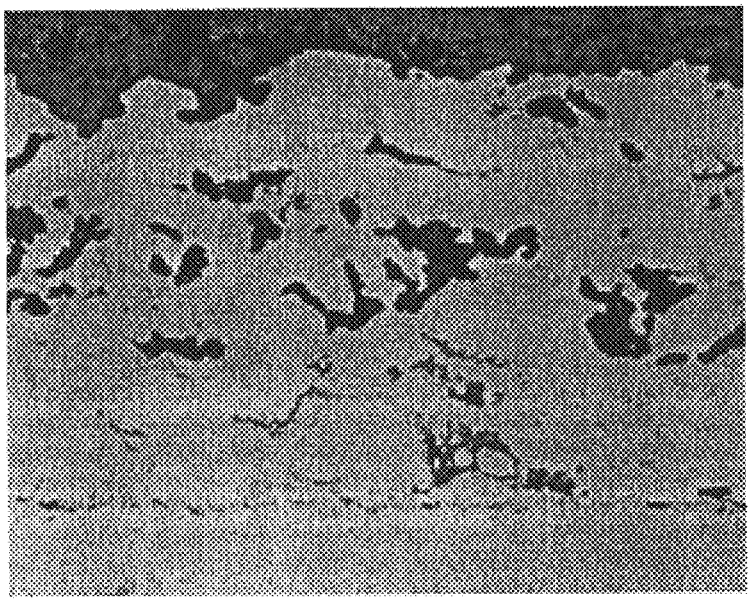

The above results evidence a remarkable 49% and 55% improvement in thermal cycle fatigue life for the Group A and B specimens, respectively. FIGS. 2 and 3 are 200× scanned images showing cross-sections of Group A specimens following the furnace cycle test. The specimen shown in FIG. 2 was heat treated in accordance with this invention, while the specimen shown in FIG. 2 was not heat treated. The scanned images clearly illustrate the considerable improvement in density and interparticle bonding achieved with this invention.

While the invention has been described in terms of a preferred embodiment, it is apparent that other forms could be adopted by one skilled in the art, such as by substituting other materials for the substrate, bond coat and thermal-insulating layers of the coating system, or by employing the resulting coating system in applications other than those noted. Therefore, the scope of the invention is to be limited only by the following claims.

What is claimed is:

1. A method for forming a thermal barrier coating system, the method comprising the steps of:

providing a superalloy substrate;

forming a bond coat on the substrate by depositing a metal powder by high velocity oxy-fuel spraying, the metal powder consisting of particles of a metallic material chosen from the group consisting of aluminum-containing intermetallics, chromium-containing intermetallics, MCrAl and MCrAlY, at least a portion of the particles having a diameter of at least 40 μm, the bond coat being characterized by a surface roughness of at least 350 microinches Ra that is attributable to the particles having a diameter of at least 40 μm being incompletely melted during deposition;

heat treating the bond coat in a vacuum or inert atmosphere at a temperature of about 950° C. to about 1150° C. for a duration of about one to about six hours to diffusion bond the metal powder and densify the bond coat without oxidizing the bond coat and the particles of the metal powder, the bond coat being characterized by a density of at least about 95% of theoretical density and the plasma spraying a ceramic layer on the bond coat.

2. A method as recited in claim 1, wherein the particles have a diameter of between 44 μm and 89 μm.

3. A method as recited in claim 1, wherein the bond coat has an oxide content after the heat treating step of not more than 3 volume percent.

4. A method as recited in claim 1, wherein the metal powder has a bimodal particle size distribution.

* * * * *